United States Patent [19]

Barbaresi

[11] 4,112,991

[45] Sep. 12, 1978

[54] CONVERTIBLE HANDBAG

[75] Inventor: Charlotte Barbaresi, Greenwich, Conn.

[73] Assignee: Acricite Company, Inc., Bridgeport, Conn.

[21] Appl. No.: 855,830

[22] Filed: Nov. 30, 1977

[51] Int. Cl.[2] ..... A45C 13/00

[52] U.S. Cl. ..... 150/28 A; 150/33

[58] Field of Search ..... 150/28 R, 28 A, 33, 150/51

[56] References Cited

U.S. PATENT DOCUMENTS

| | | | |
|---|---|---|---|
| 1,960,396 | 5/1934 | Rosenberg | 150/28 A |
| 1,990,360 | 2/1935 | Anish | 150/28 A |
| 2,053,464 | 9/1936 | Dalsheim | 150/28 A |
| 2,131,382 | 9/1938 | Lobel | 150/28 A |
| 2,182,879 | 12/1939 | Rinehart | 150/28 A |
| 2,609,854 | 9/1952 | Rosen | 150/28 A |
| 2,653,640 | 9/1953 | Browning | 150/28 A |
| 2,779,373 | 1/1957 | Koepke | 150/28 A |
| 2,837,132 | 6/1958 | Daust | 150/28 A |
| 2,845,974 | 8/1958 | Arden | 150/28 R |
| 2,880,775 | 4/1959 | Beattie | 150/28 R |

*Primary Examiner*—Ro E. Hart

*Attorney, Agent, or Firm*—Parmelee, Johnson, Bollinger & Bramblett

[57] ABSTRACT

A handbag having a relatively rigid basket-like frame and a soft fabric bag carried therein. The bag includes pocketed flaps which engage wings formed on the basket. Additional securement is obtained by means of handle chains which loop through openings in the basket and bag.

4 Claims, 5 Drawing Figures

Fig. 1.
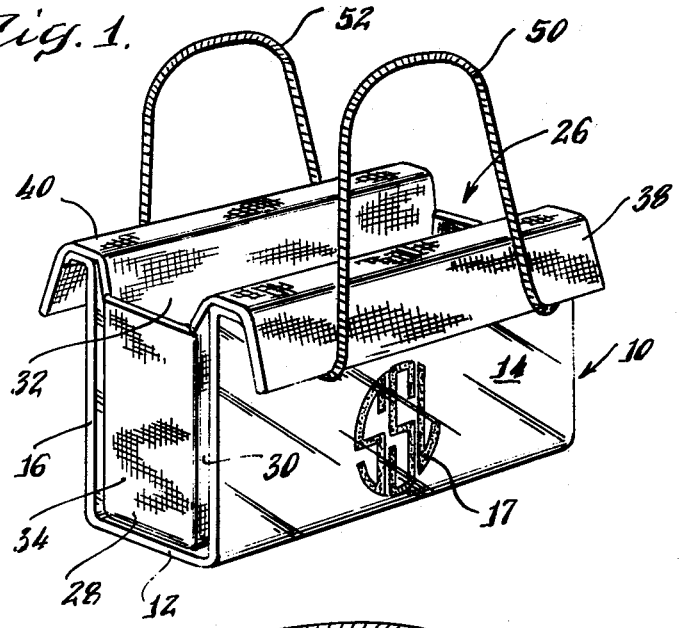
Fig. 3.
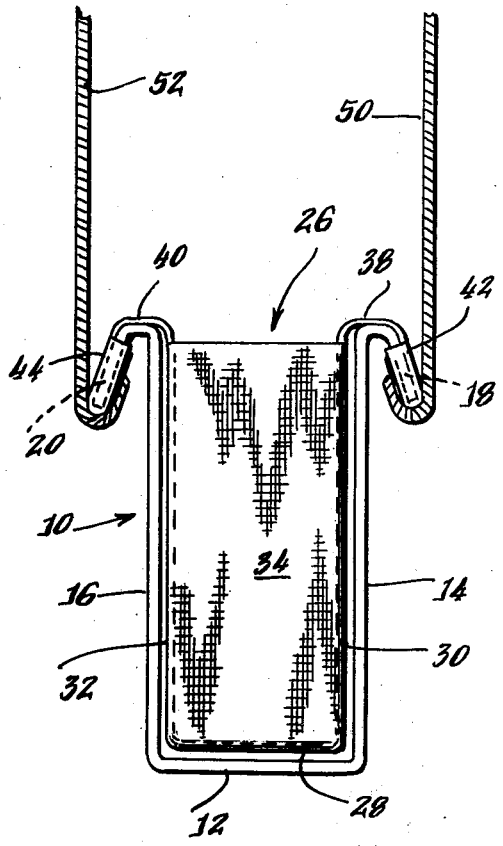
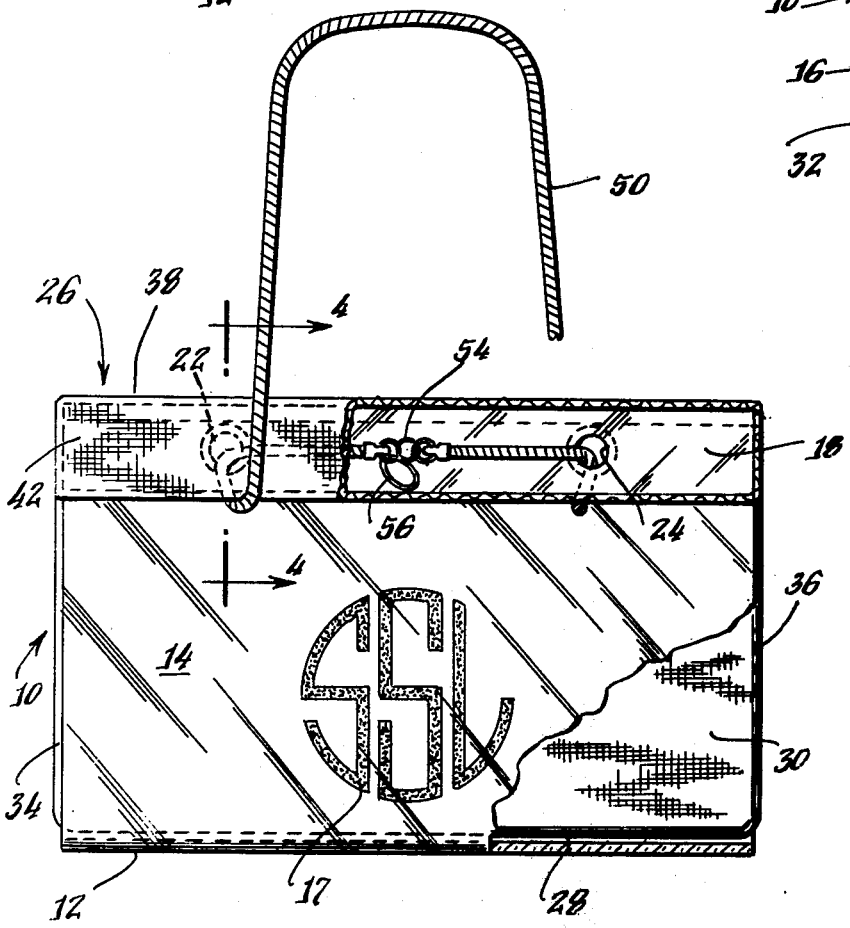
Fig. 2.
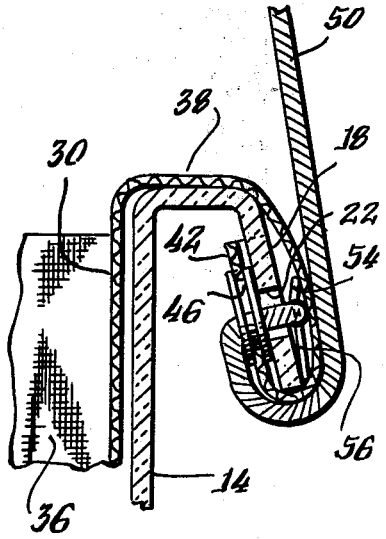
Fig. 4.

CONVERTIBLE HANDBAG

BACKGROUND OF THE INVENTION

This invention pertains to handbags and more particularly to a handbag which is easily convertible in style or color. While convertible handbags have been known in the prior art, they are usually of the type wherein only the bag and its handle are interchangeable. If some type of personalizing is desired, such as a monogram, it must be placed on the handle. Otherwise, it must be provided on each of the replacement bags, an undesirable additional expense. This obviously cannot be done on a bag with chain handles, which are often desired.

Accordingly, it is a primary object of the present invention to provide a handbag with chain handles and a replaceable flexible bag but including a permanent member which may be suitably engraved. Other objects, features, and advantages will be apparent from the following description and appended claims.

SUMMARY OF THE INVENTION

A convertible handbag which comprises a relatively rigid basket member including first and second spaced side panels defining an opening therebetween and first and second elongated wing members depending from the respective first and second side panels adjacent the opening and extending outwardly therefrom. A bag is supported within the basket and includes a mouth positioned within the basket opening. First and second elongated flexible flaps extend from the bag on opposite sides of the mouth and means are associated with the flaps for interlocking with the first and second wing members.

BRIEF DESCRIPTION OF THE DRAWINGS

FIG. 1 is a perspective view of a handbag in accordance with the invention;

FIG. 2 is an enlarged elevational view of the handbag of FIG. 1, portions thereof being broken away to illustrate its construction;

FIG. 3 is an end view of the bag of FIG. 2;

FIG. 4 is an enlarged cross section taken substantially along the line 4—4 of FIG. 2; and, FIG. 5 is a perspective view illustrating the interrelationship of the various elements of the handbag.

DESCRIPTION OF THE PREFERRED EMBODIMENT

Figure 5:
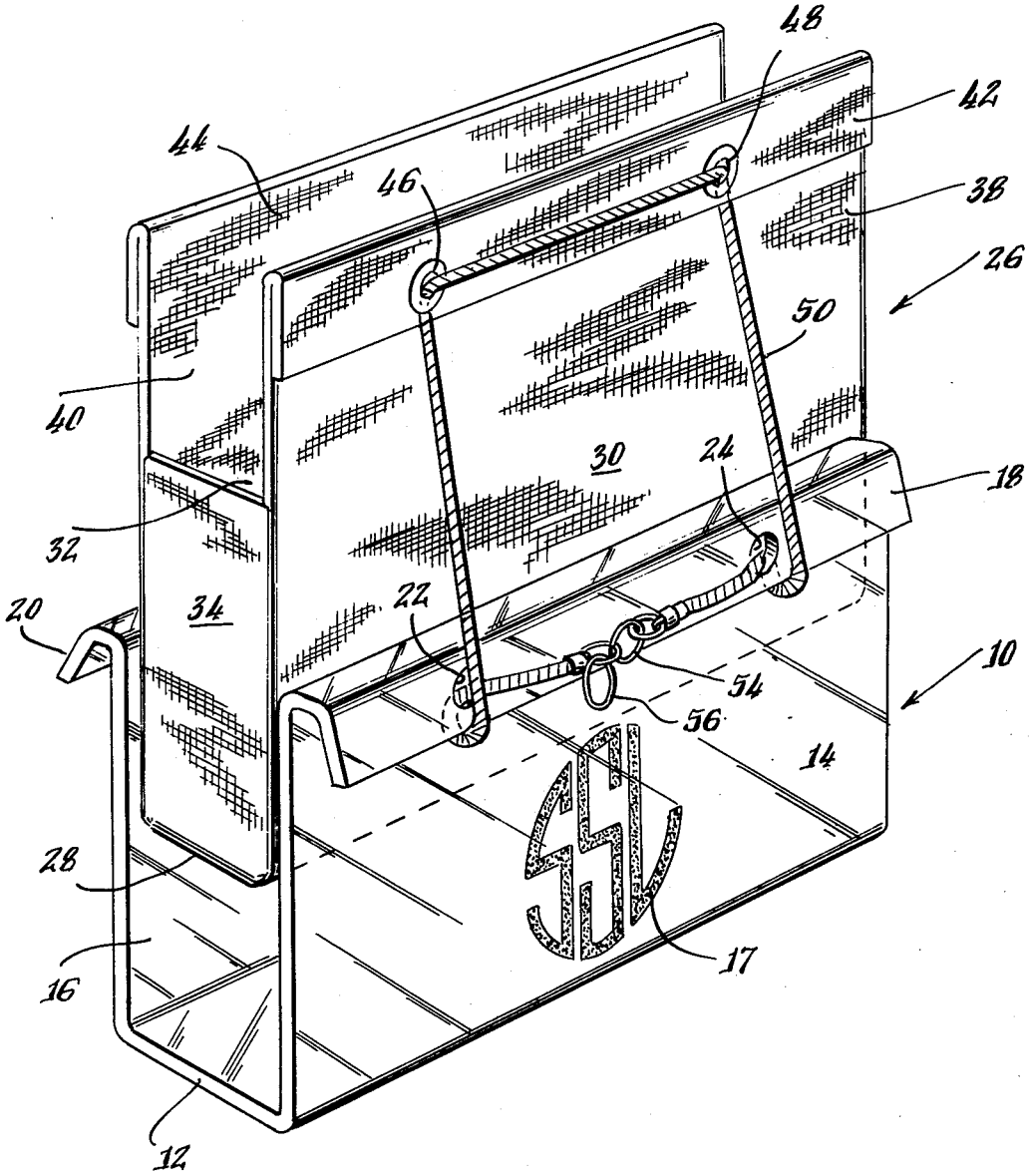

With particular reference to the drawings, there is illustrated a bag comprising a rigid basket member 10 which is substantially U-shaped in cross section having a planar bottom 12 and first 14 and second 16 side panels. In the illustrated embodiment, first side panel 14 carries an engraved monogram 17. The basket member 10 is formed from a single piece of material such as transparent lucite and the top of each of the side panels is bent to form a pair of wing members 18, 20 depending therefrom and angled slightly outwardly as illustrated. Each of the wing members defines a pair of spaced holes 22, 24 therethrough.

Supported within the basket member 10 is a flexible cloth bag 26 having a bottom 28, side panels 30, 32, and end panels 34, 36. Side panels 30, 32 extend beyond the open mouth of the bag in the form of a pair of elongated flaps 38, 40. The edges of flaps 38, 40 are folded back upon themselves and stitched along the ends to form a pair of pockets 42, 44. Each of the pockets includes a pair of spaced holes 46, 48 which extend only through the turned back portion of the flaps. The distance between holes 46 and 48 is approximately the same as that between the holes 22, 24.

Secured to each of wing members 18, 20 is a respective handle chain 50, 52. Each of the chains includes a catch 54 which may be of the sliding ring type commonly used with necklaces and watch chains. A metal containment ring 56 is secured to an end of each chain and is larger in diameter than the holes 22, 24 in the wing members 18, 20. In addition to serving as handles for the handbag, the chains 50, 52 serve the additional important function of securing the bag 26 within the basket member 10. The manner in which this is accomplished may be best understood by the following description read in conjunction with FIG. 5.

The flexible bag 26 is positioned within the basket member 10. Thereafter, the end of chain 50 which does not carry the containment ring 56 is laced inwardly and downwardly through the hole 22 in wing member 18. It is then brought upward and laced through the hole 46 in pocket 42 from the inside of the pocket outwardly. It is then laced in an opposite manner through the hole 48 in pocket 42 and is brought downwardly around the edge of the wing member 18 and through the hole 24 from inside to outside. The ends of the chain are then joined by the catch 54. Thereafter, the fabric pocket 42 is slipped over the wing member 18, the chain member 50 being drawn upwardly so that its bight forms a handle as shown in FIGS. 1 and 2. The same procedure is repeated on the opposite side of the handbag to secure the pocket 44 to the wing member 20 by means of chain 52. In the final configuration as shown in FIGS. 1 and 2, the catch 54 is completely concealed. The function of containment ring 56 is to keep the catch concealed as this ring is too large to pass through either of the holes 22, 24.

It will now be seen that there has been provided a handbag having a rigid, external basket member which, if desired, may be suitably engraved or otherwise marked with the owner's monogram. It is preferably, though not necessarily, formed from a transparent colorless material such as lucite. Secured within the basket member is flexible bag which may be of any desired color to match the wearer's ensemble and which may be readily removed and replaced by a bag of different color or pattern. Furthermore, the means by which the bag is secured to the basket remains hidden from casual view.

It is believed that the advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. A convertible handbag which comprises: a relatively rigid basket member including first and second spaced side panels defining an opening therebetween; first and second elongated wing members depending, respectively, from said first and second side panels, adjacent said opening and extending outwardly therefrom; a bag supported within said basket defining a mouth positioned within said basket opening; first and second elongated flexible flaps extending from said bag on opposite sides of said mouth; and means associated with said flaps for interlocking with said first and second wing members.

2. The handbag of claim 1 wherein said interlocking means comprises a pocket formed in each of said first and second flaps for enclosing therein a respective one of said first and second wing members.

3. The handbag of claim 2 wherein said pockets and wing members define aligned holes therein and said interlocking means comprises first and second elongated, flexible handles, each passing through the aligned holes of a respective pocket and wing member pair.

4. The handbag of claim 3 wherein each of said handles comprises a chain having its ends joined by a releasable catch.

* * * * *